US010825436B2

(12) United States Patent
Yan et al.

(10) Patent No.: US 10,825,436 B2
(45) Date of Patent: Nov. 3, 2020

(54) METHODS AND SYSTEMS FOR SYNCHRONIZING MIDI FILE WITH EXTERNAL INFORMATION

(71) Applicant: SUNLAND INFORMATION TECHNOLOGY CO., LTD., Shanghai (CN)

(72) Inventors: Bin Yan, Shanghai (CN); Xiaolu Liu, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/380,503

(22) Filed: Apr. 10, 2019

(65) Prior Publication Data

US 2019/0237054 A1 Aug. 1, 2019

Related U.S. Application Data

(63) Continuation of application No. PCT/CN2016/102165, filed on Oct. 14, 2016.

(51) Int. Cl.

| | |
|---|---|
| ***G10H 1/36*** | (2006.01) |
| ***G10F 1/02*** | (2006.01) |
| ***G10G 3/04*** | (2006.01) |
| ***G10H 1/00*** | (2006.01) |
| ***G10F 1/18*** | (2006.01) |
| ***G10F 1/20*** | (2006.01) |

(52) U.S. Cl.

CPC ..... *G10H 1/368* (2013.01); *G10F 1/02* (2013.01); *G10G 3/04* (2013.01); *G10H 1/0008* (2013.01); *G10H 1/0066* (2013.01); *G10F 1/18* (2013.01); *G10F 1/20* (2013.01); *G10H 2210/031* (2013.01); *G10H 2220/091* (2013.01); *G10H 2240/311* (2013.01); *G10H 2240/325* (2013.01)

(58) Field of Classification Search

CPC .... G10H 1/368; G10H 1/0008; G10H 1/0066; G10H 2210/031; G10H 2240/311; G10H 2220/091; G10H 2240/325; G10G 3/04; G10F 1/02; G10F 1/20; G10F 1/18

See application file for complete search history.

(56) References Cited

U.S. PATENT DOCUMENTS 5,265,248 A 11/1993 Moulios et al.
5,530,859 A * 6/1996 Tobias, II ..... G06F 16/40 713/400
5,569,869 A * 10/1996 Sone ..... G10H 1/0066 84/609

(Continued)

OTHER PUBLICATIONS

International Search Report in PCT/CN2016/102165 dated Jul. 21, 2017, 4 pages.

(Continued)

*Primary Examiner* — Jeffrey Donels
(74) *Attorney, Agent, or Firm* — Metis IP LLC

(57) ABSTRACT

A method relating to synchronize MIDI file with video includes acquiring a video and a MIDI file, and identifying timing of a video frame. The method also includes converting timing into tick information and editing a tick of the MIDI file. The method further includes detecting the MIDI file corresponding to the video frame, and playing a musical instrument based on the MIDI file corresponding to the video.

20 Claims, 5 Drawing Sheets

(56) References Cited

U.S. PATENT DOCUMENTS

| | | | | |
|---|---|---|---|---|
| 6,078,005 | A * | 6/2000 | Kurakake | G11B 27/034 84/477 R |
| 6,143,973 | A * | 11/2000 | Kikuchi | G10H 1/0066 84/600 |
| 6,949,705 | B2 * | 9/2005 | Furukawa | G10H 1/0041 84/610 |
| 7,512,886 | B1 | 3/2009 | Herberger et al. | |
| 7,589,274 | B2 * | 9/2009 | Funaki | G10H 1/0058 84/645 |
| 2002/0168176 | A1 * | 11/2002 | Iizuka | G10H 1/40 386/248 |
| 2005/0150362 | A1 | 7/2005 | Uehara | |
| 2006/0227245 | A1 | 10/2006 | Poimboeuf et al. | |
| 2007/0051228 | A1 | 3/2007 | Weir et al. | |
| 2008/0019667 | A1 | 1/2008 | Uehara | |
| 2008/0168470 | A1 * | 7/2008 | Bushell | G06F 9/52 719/313 |
| 2012/0086855 | A1 | 4/2012 | Xu et al. | |

OTHER PUBLICATIONS

Written Opinion in PCT/CN2016/102165 dated Jul. 21, 2017, 5 pages.

First Office Action in Chinese application No. 201680087905.4 dated Aug. 19, 2020, 15 pages.

* cited by examiner

METHODS AND SYSTEMS FOR SYNCHRONIZING MIDI FILE WITH EXTERNAL INFORMATION

CROSS-REFERENCE TO RELATED APPLICATIONS

This present application is a continuation of International Application No. PCT/CN2016/102165, filed on Oct. 14, 2016, the entire contents of which are hereby incorporated by reference.

TECHNICAL FIELD

This present disclosure generally relates to musical instrument digital interface file, and more particularly, relates to methods and systems for synchronizing musical instrument digital interface file with external information including, for example, video.

BACKGROUND

In the early 1980s, musical instrument digital interface (MIDI) technology facilitates the development of modern music. Smart instrument based on MIDI technology makes instrument training easier. However, MIDI file may mismatch video if the video is played in a mode of fast-forward or slow-forward and vice versa. Therefore, synchronizing MIDI file with external information, and achieving simultaneous playing of video and MIDI file is crucial.

SUMMARY

According to an aspect of the present disclosure, a system may include a smart instrument system, a storage medium, and one or more processor in communication with the smart instrument system and the storage medium. The smart instrument configured to obtain a video and a musical instrument digital interface (MIDI) file associated with a music, the video including a plurality of video frames, and the MIDI file including a plurality of ticks. The storage medium including a set of instructions for synchronizing the video with the MIDI file. Further, the one or more processors, when executing the set of instructions, are directed to: identify timing information of at least one video frame of the plurality of video frames; convert the timing information into tick information; edit at least one tick of the MIDI file based on the tick information, so that when playing, the music is synchronous with the video.

According to an aspect of the present disclosure, a method may include obtaining, by a smart instrument system, a video and a musical instrument digital interface (MIDI) file associated with a music, the video including a plurality of video frames, and the MIDI file including a plurality of ticks; identifying, by the smart instrument system, timing information of at least one video frame of the plurality of video frames; converting, by the smart instrument system, the timing information into video tick information; and editing, by the smart instrument system, at least one tick of the MIDI file based on the video tick information, so that when playing, the music is synchronous with the video.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

In the following detailed description, numerous specific details are set forth by way of example in order to provide a thorough understanding of the relevant disclosure. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

It will be understood that the term "system," "module" and/or "unit" used herein are one method to distinguish different components, elements, parts, section or assembly of different level in ascending order. However, the terms may be displaced by other expression if they may achieve the same purpose.

It will be understood that when a device, unit, or module is referred to as being "on," "connected to," or "coupled to" another device, unit, or module, it may be directly on, connected or coupled to, or communicate with the other device, unit, or module, or an intervening device, unit, or module may be present, unless the context clearly indicates otherwise. As used herein, the term "and/or" includes any and all combinations of one or more of the associated listed items.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

Figure 1:
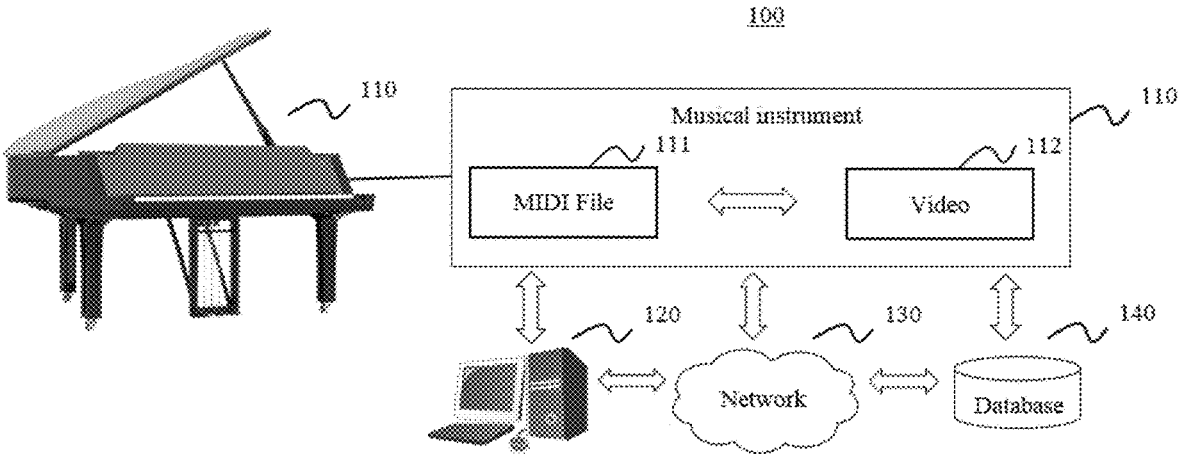
FIG. 1 illustrates a block diagram of an exemplary smart instrument system according to some embodiments of the present disclosure.

FIG. 1 illustrates a block diagram of an exemplary smart instrument system according to some embodiments of the present disclosure. Smart instrument system 100 may be used in various fields including, for example, smart instrument, music program, concert performance, music exchange, house concert, music education, music festival, or the like, or any combination thereof. As illustrated in FIG. 1, exemplary smart instrument system 100 may include a musical instrument 110, a processor 120, a network 130, and a database 140. In some embodiments, musical instrument 110 may include a MIDI file 111 and a video 112.

Musical instrument 110 may be configured to perform music. The music performed may have one or more musical forms, including, for example, a piano music, an orchestral music, a string music, a wind music, a drum music, or the like, or any combination thereof. In some embodiments, musical instrument 110 may have one or more working modes, including, for example, automatic play mode (musical instrument may play automatically without user participation, i.e., user learning mode), semi-automatic play mode (user may play with musical instrument following instructions of smart instrument system 100, i.e., user training mode), and/or non-automatic play mode (user may play musical instrument without instructions, i.e., user play mode).

In some embodiments, musical instrument 110 may include a playing device (not shown) for performing music. The device for performing music may include a piano, an electrical piano, a piano accordion, an organ, an electrical keyboard, a harp, a violoncello, a viola, a violin, a guitar, a ukulele, a harpsichord, or the like, or any combination thereof.

In some embodiments, musical instrument 110 may include an input/output (I/O) device (not shown). The I/O device may receive information from or transmit information to processor 120, a local storage (not shown), or database 140 via network 130. The I/O device may include a MIDI interface, a display, a player, a key, a string, or the like, or any combination thereof. In some embodiments, the display may include a liquid crystal display (LCD), a light emitting diode display (LED), an organic light emitting diode display (OLED), a quantum LED display (QLED), a flat panel display or curved screen, a cathode ray tube (CRT), a 3D display, a plasma display panel, or the like, or any combination thereof. The display may display information. The information displayed may be related with the status of musical instrument 110, the user of musical instrument 110, evaluation of the user, or instructions for the user, or the like, or any combination thereof. The information displayed may be a video 112, a value, a text, an image, a user interface, or the like, or any combination thereof. In some embodiments, the user interface may be a user interaction interface, a graphical user interface, or a user-defined interface, or the like, or any combination thereof. The user interface may facilitate a user to interact with one or more components of smart instrument system 100 (e.g., musical instrument 110, processor 120, and/or database 140). For example, a user may select a working mode for musical instrument 110 through the user interface. In some embodiments, the user interface may be implemented by processor 120.

In some embodiments, musical instrument 110 may include a local storage (not shown) to store information. The information stored may be generated by musical instrument 110, received from processor 120, a local storage (not shown), or database 140 via network 130. In some embodiments, the information stored may include a MIDI file 111, and/or a video 112. The information stored may also include a set of instructions implemented as an application to be operated by one or more processors of the system 100. The application may be the methods as introduced in the present disclosure. In some embodiments, smart instrument system 100 may use MIDI file 111 to instruct the performance of musical instrument 110. MIDI file 111 may include one or more MIDI records. A MIDI record may include information regarding instruction(s) for musical instrument 110, including an on/off state of key or pedal, a press strength of key or pedal, a kind of musical tone, or the like, or any combination thereof.

In some embodiments, musical instrument 110 may include a pressing control device. In some embodiments, the pressing control device may be driven by a current. The pressing control device may control the press strength of a key or pedal based on the current amplitude.

In some embodiments, video 112 may be related with music performance. Video 112 may include a musical tone, a background music, a volume, a play mode, a number, a character, a text, an image, a voice, an instruction, or the like, or any combination thereof. In some embodiments, video 112 may be played on display in different play modes. Under automatic play mode and/or non-automatic play mode, video 112 may be automatically displayed during instrumental performance. Under semi-automatic play mode, video 112 may be displayed for instructing the user to play musical instrument 110. For example, video 112 may show a virtual key or pedal to instruct the user which key or pedal may be pressed, and/or how long it may be pressed. In some embodiments, under non-automatic play mode, video 112 may be not played. In some embodiments, musical tone may include timbre, pitch, duration of a tone, intensity of a tone, or the like, or any combination thereof. In some embodiments, information regarding the musical tone may be performed and/or collected by musical instrument 110. The information of musical tone may include raw data, processed data, control data, interaction data, image data, video data, analog data, digital data, or the like, or any combination thereof. In some embodiments, smart instrument system 100 may synchronize MIDI file 111 and video 112.

In some embodiments, MIDI file 111, and/or video 112 may be stored in database 140, and musical instrument 110 may acquire MIDI file 111, and/or video 112 from database 140 via network 130. In some embodiments, MIDI file 111, and/or video 112 may be stored in a local storage (not shown). The local storage may be located in musical instrument 110, processor 120, and/or other component(s) of smart instrument system 100. The local storage may be a mass storage, a removable storage, a volatile read-and-write memory, a read-only memory (ROM), or the like, or any combination thereof. Exemplary mass storage may include a magnetic disk, an optical disk, a solid-state drives, etc. Exemplary removable storage may include a flash drive, a floppy disk, an optical disk, a memory card, a zip disk, a magnetic tape, etc. Exemplary volatile read-and-write memory may include a random access memory (RAM). Exemplary RAM may include a dynamic RAM (DRAM), a double date rate synchronous dynamic RAM (DDR SDRAM), a static RAM (SRAM), a thyristor RAM (T-RAM), and a zero-capacitor RAM (Z-RAM), etc. Exemplary ROM may include a mask ROM (MROM), a programmable ROM (PROM), an erasable programmable ROM (PEROM), an electrically erasable programmable ROM (EEPROM), a compact disk ROM (CD-ROM), and a digital versatile disk ROM, etc.

Processor 120 may be configured to process information of musical instrument 110, a local storage (not shown), or database 140. In some embodiments, processor 120 may perform operations including, for example, processing data, editing MIDI file, setting parameter(s), matching video, selecting play mode, or the like, or any combination thereof. In some embodiments, the data processed and/or generated by processor 120 may be transmitted to other component(s) of smart instrument system 100, including, for example, musical instrument 110, and/or database 140. In some embodiments, the data processed and/or generated by processor 120 may be transmitted to a memory for storing (not shown). The memory may be a local storage and/or remote storage. For example, the memory may be a Random Access Memory (RAM), a Read Only Memory (ROM), a hard disk, a magnetic disk, a USB disk, a CD, a DVD, a cloud storage, or the like, or any combination thereof. In some embodiments, the data processed and/or generated by processor 120 may be transmitted to and displayed by component(s) of musical instrument 110. In some embodiments, the data processed and/or generated by processor 120 may be transmitted to an external device, for example, a remote terminal (not shown) over network 130.

In some embodiments, processor 120 may generate a control signal for controlling one or more components of smart instrument system 100. For example, processor 120 may control musical tone, key press strength, pedal pump strength, play speed, and/or on/off state of key of musical instrument 110. As another example, processor 120 may receive a command provided by a user through, for example, the I/O device of musical instrument 110. In some embodiments, processor 120 may control the communication between components of smart instrument system 100. For example, processor 120 may control information transmission from musical instrument 110 to database 140 and vice versa. As another example, processor 120 may control the connection of musical instrument 110 to network 130.

In some embodiments, processor 120 may include a processor-based and/or microprocessor-based unit. Merely by way of examples, processor 120 may include a microcontroller, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an advanced RISC machine (ARM), or any other circuit or processor capable of executing one or more functions described herein. In some embodiments, processor 120 may also include a memory (e.g., a random access memory (RAM) or a read only memory (ROM).

It should be understood, processor 120 may connect with or be configured within the present smart instrument system 100 as described herein, and the functions of processor are not exhaustive and are not limiting. Numerous other changes, substitutions, variations, alterations, and modifications may be ascertained to one skilled in the art. And it is intended that the present disclosure encompass all such changes, substitutions, variations, alterations, and modifications as falling within the scope of the present disclosure. Merely by way of example, processor 120 may be implemented in various manners. In some embodiments, processor 120 may be configured within musical instrument 110. In some embodiments, processor 120 may be implemented by hardware, software, and/or a combination of hardware and software (e.g., firmware). The hardware may include a hardware circuit, a programmable logic device, an ultra large scale integrated circuit, a gate array chip, a semiconductor device (e.g., a transistor), or a field programmable gate array (FPGA).

Network 130 may be configured to facilitate communications among the components of smart instrument system 100 (e.g., musical instrument 110, processor 120, and database 140). For example, network 130 may transmit data from musical instrument 110 to processor 120. Network 130 may also transmit data processed and/or generated by processor 120 to musical instrument 110. In some embodiments, network 130 may be any type of wired network, wireless network or Ethernet that allows transmitting and receiving data. In some embodiments, network 130 may include a nanoscale network, a near field communication (NFC), a body area network (BAN), a personal area network (PAN, e.g., a Bluetooth, a Z-Wave, a Zigbee, a wireless USB), a near-me area network (NAN), a local wireless network, a backbone, a metropolitan area network (MAN), a wide area network (WAN), an internet area network (IAN, or cloud), or the like, or any combination thereof. It may be contemplated that network 130 may use any known communication method which provide a medium for transmitting data between two or more separate components. In some embodiments, musical instrument 110, processor 120, network 130, and/or database 140 may be connected to or communicate with each other directly or indirectly.

Database 140 may be configured to acquire and/or store information of the components of smart instrument system 100 (e.g., musical instrument 110, processor 120, and network 130). For example, database 140 may acquire information of the user playing musical instrument 110. In some embodiments, the information acquired and/or stored may include a video regarding musical instrument fingering, a MIDI file of musical instrument performance, or the like, or any combination thereof. In some embodiments, the user may be a musician, a pianist, a music star, a celebrity, a musical educator, a musical instrument professor, or the like, or any combination thereof. In some embodiments, database 140 may store information regarding the learning process of user(s). In some embodiments, user(s) may select a training mode based on the information regarding the learning process, which may facilitate user(s) to make a progress in playing musical instrument 110 or other instrument(s). In some embodiments, database 140 may store information regarding the process of a musician or a music star in playing musical instrument 110 or other instrument(s).

Merely by way of example, user(s) may select a music star, and play with the music star based on information regarding the playing process of the music star.

In some embodiments, two or more components of smart instrument system 100 (i.e., musical instrument 110, processor 120, network 130, and/or database 140) may be integrated together. For example, musical instrument 110 and processor 120 may be integrated as one device. In some embodiments, function of smart instrument system 100 may be implemented by musical instrument 110, processor 120, network 130, database 140, or any combination thereof. In some embodiments, one or more of the above components may be remote from each other. Merely by way of example, processor 120 may be implemented on a cloud platform (e.g., a cloud computing platform or a cloud storing platform). As another example, musical instrument 110 may be controlled by a remote system (e.g., a remote performance system or a remote ensemble system).

Figure 2:
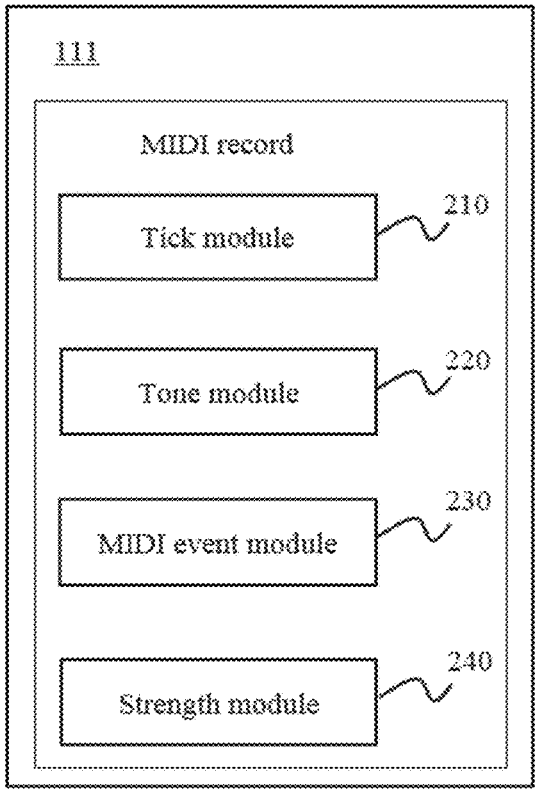
FIG. 2 illustrates a block diagram of an exemplary MIDI file according to some embodiments of the present disclosure.

FIG. 2 illustrates a block diagram of an exemplary MIDI file 111 according to some embodiments of the present disclosure. MIDI file 111 may include one or more MIDI records. In some embodiments, a MIDI record may include a tick module 210, a tone module 220, a MIDI event module 230, and a strength module 240.

Tick module 210 may include a plurality of data representing tick information. Tick information may be related with the timing information of one or more MIDI events. In some embodiments, processor 120 may match tick information of MIDI file 111. In some embodiments, processor 120 may synchronize MIDI file 111 and video 112 based on tick information. In some embodiments, processor 120 may convert tick information based on timing information of video 112. In some embodiments, processor 120 may execute MIDI file 111 and induce musical instrument 110 to perform music. In some embodiments, MIDI file 111 may be executed based on tick information of tick module 210.

Tone module 220 may include a plurality of data representing tone information. In some embodiments, tone information may include different kinds (e.g., 128 kinds) of musical tone of musical instrument 110. In some embodiments, musical instrument 110 may play musical tone based on tone information. In some embodiments, processor 120 may control musical tone of musical instrument 110 based on tick information, and/or tone information in MIDI file 111. For example, processor 120 may control the on/off state of 128 kinds of musical tone according to tick information of tick module 210. As another example, processor 120 may determine which key(s) of musical instrument 110 may be pressed based on tone information of tone module 220.

MIDI event module 230 may include a plurality of data representing event information. Event information may relate to one or more motion instructions. In some embodiments, MIDI event module 230 may include a motion instruction of keyboard, pedal, or the like, or any combination thereof. The motion instruction may refer to pressing or rebounding a key, pedal, or the like, or any combination thereof. In some embodiments, MIDI event module 230 may relate to tone module 220. For example, tone module 220 may instruct which musical tone may be played, and MIDI event module 230 may instruct a motion of keyboard, and/or pedal to realize playing the musical tone.

Strength module 240 may include a plurality of data representing strength information. Strength information may indicate the press strength of keyboard and/or pedal of musical instrument 110. In some embodiments, processor 120 may control the press strength based on strength information. In some embodiments, processor 120 may define the press strength based on strength module 240. For example, processor 120 may control tension of keyboard within music instrument 110 based on strength module 240. Musical instrument 110 may apply the press strength to keyboard and/or pedal through applying a certain current to the pressing control device within musical instrument 110. In some embodiments, the current may have certain magnitude, and/or frequency.

Figure 3:
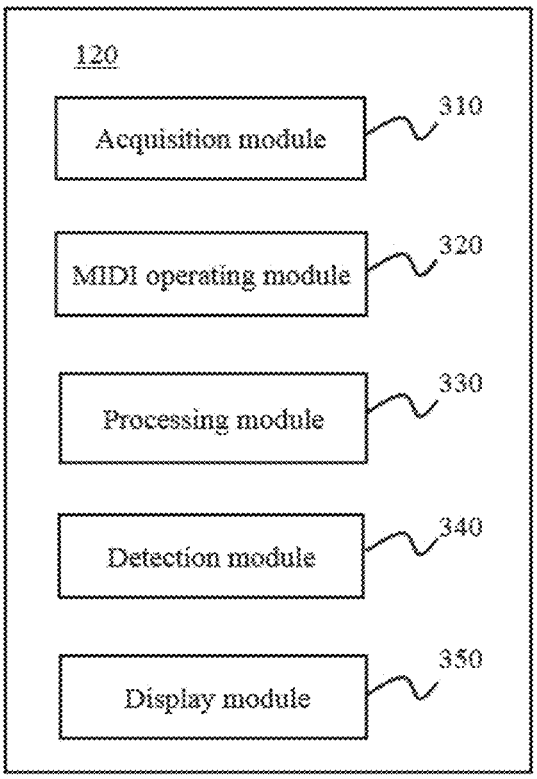
FIG. 3 illustrates a block diagram of an exemplary processor according to some embodiments of the present disclosure.

FIG. 3 illustrates a block diagram of an exemplary processor 120 according to some embodiments of the present disclosure. Processor 120 may include an acquisition module 310, a MIDI operating module 320, a processing module 330, a detection module 340, and a display module 350.

Generally, the word "module", as used herein, refers to logic embodied in hardware of firmware, or to a collection of software instructions. The modules described herein may be implemented as software and/or hardware modules, and may be stored in any type of non-transitory computer-readable medium or other storage device. In some embodiments, a software module can be compiled and linked into an executable program. It will be appreciated that software modules can be callable from other modules or from themselves, and/or can be invoked in response to detected events or interrupts. Software modules configured for execution on computing devices (e.g., processor 120) can be provided on a computer readable medium, such as a compact disc, digital video disc, flash drive, magnetic disc, or any other tangible medium, or as a digital download (and can be originally stored in a compressed or installable format that requires installation, decompression, or decryption prior to execution). Such software code can be stored, partially or fully, on a memory device of the executing computing device, for execution by the computing device. Software instructions can be embedded in firmware, such as an EPROM. It will be further appreciated that hardware modules can be comprised of connected logic units, such as gates and flip-flops, and/or can be comprised of programmable units, such as programmable gate arrays or processors. The modules or computing device functionality described herein are preferably implemented as software modules, but can be represented in hardware or firmware. In general, the modules described herein refer to logical modules that can be combined with other modules or divided into sub-modules despite their physical organization or storage.

Acquisition module 310 may be implemented on processor 120. Acquisition module 310 may be configured to acquire one or more performances of musical instrument 110. For example, acquisition module 310 may acquire one or more videos recorded by a video camera mounted on musical instrument 110 or other instruments. In some embodiments, acquisition module 310 may acquire one or more videos stored in database 140. In some embodiments, acquisition module 310 may acquire one or more MIDI files based on performance of musical instrument 110 or other instruments. For example, MIDI file(s) may be recorded by software within musical instrument 110 or processor 120.

MIDI operating module 320 may be configured to operate MIDI file 111. MIDI file 111 operated may be acquired from acquisition module 310. In some embodiments, MIDI operating module 320 may edit tick information of MIDI file 111. MIDI operating module 320 may identify MIDI file 111 corresponding to video 112. In some embodiments, MIDI operating module 320 may control MIDI file in order to play musical instrument 110. In some embodiments, MIDI operating module 320 may play MIDI file, and musical instrument 110 may perform music accordingly. In some embodiments, acquisition module 310 may acquire data, MIDI file(s), and/or video information stored in database 140, and MIDI operating module 320 may generate a modified MIDI file based on acquired data, MIDI file(s), and/or video information.

Processing module 330 may be configured to execute one or more instructions in accordance with techniques described herein. The instructions may include routines, programs, objects, components, data structures, procedures, modules, and functions, which perform one or more functions described herein. In some embodiments, processing module 330 may analyze instructions transmitted from musical instrument 110 and/or other instruments. For example, if a user inputs an indication of recording performance of musical instrument 110 into musical instrument 110, musical instrument 110 may convert the indication into a command and transmit the command to processing module 330, and processing module 330 may analyze the command and give instruction(s) to acquisition module 310 to acquire the performance of musical instrument 110. As another example, video 112 may be captured by a video camera mounted on musical instrument 110 or other instruments, and processing module 330 may receive, store, and/or analyze video 112 according to instructions of musical instrument 110 or other instruments. In some embodiments, processing module 330 may give instruction(s) to MIDI operating module 320 to edit MIDI file 111 corresponding to video 112. In some embodiments, processing module 330 may match MIDI file 111 to video 112, or synchronizing MIDI file 111 and video 112 according to instructions of musical instrument 110. Merely by way of example, processing module 330 may convert timing information of video 112 into tick information. In some embodiments, processing module 330 may give instruction(s) to MIDI operating module 320 to edit MIDI file 111 based on tick information. In some embodiments, processing module 330 may transmit control signal to musical instrument 110.

Detection module 340 may be configured to detect information. The information may include MIDI file 111, video 112, performance of musical instrument 110 or other instruments, or the like, or any combination thereof. In some embodiments, detection module 340 may identify video information. The video information may include timing information of video frame. For example, video frame may include information of pressing a piano key at a moment. In some embodiments, the moment may correspond to the timing information. In some embodiments, MIDI operating module 320 may identify MIDI file 111 corresponding to video 112 based on timing information of video frame detected by detection module 340. In some embodiments, detection module 340 may identify performance of musical instrument 110 based on MIDI file 111. In some embodiments, detection module 340 may identify video 112 corresponding to MIDI file 111 based on tick information of MIDI file 111.

Display module 350 may be configured to display video 112 based on performance of musical instrument 110 or other instruments. In some embodiments, display module 350 may be embed in musical instrument 110. In some embodiments, display module 350 may include different play modes, e.g., fast-forward, slow-forward, skip, backward, pause, stop, or the like. In some embodiments, display module 350 may perform one or more functions of display within musical instrument 110 described elsewhere in this disclosure.

Figure 4:
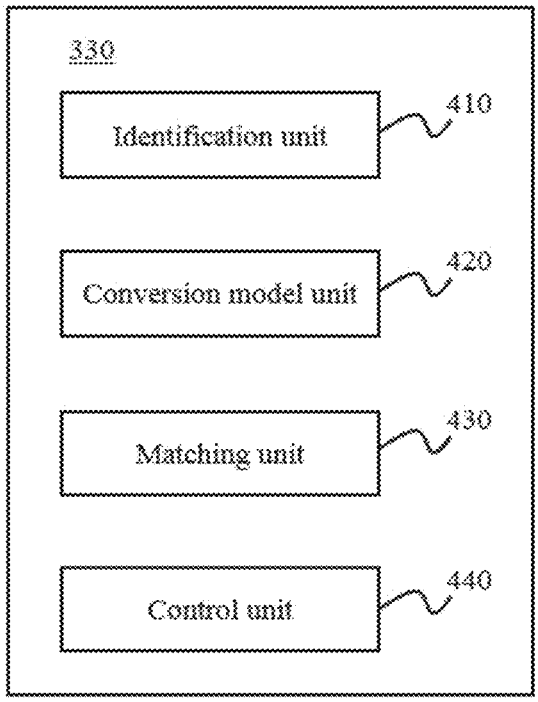
FIG. 4 illustrates a block diagram of an exemplary processor module according to some embodiments of the present disclosure.

FIG. 4 illustrates a block diagram of an exemplary processing module 330 according to some embodiments of the present disclosure. In some embodiments, processing module 330 may include an identification unit 410, a conversion model unit 420, a matching unit 430 and a control unit 440.

Identification unit 410 may be configured to identify timing information. In some embodiments, identification unit 410 may identify timing information of video 112. For example, timing information of each video frame may be identified. In some embodiments, identification unit 410 may further identify MIDI file 111 matching video frame(s) of video 112. For example, identification unit 410 may identify MIDI file 111 based on timing information of video 112. In some embodiments, identification unit 410 may be integrated into detection module 340.

Conversion model unit 420 may be configured to convert timing information. In some embodiments, conversion model unit 420 may convert timing information into tick information. For example, conversion model unit 420 may convert timing information based on a mathematical model. In some embodiments, identification unit 410 may identify tick of MIDI file 111 based on tick information converted by conversion model unit 420.

Matching unit 430 may be configured to synchronize MIDI file 111 with video 112. In some embodiments, matching unit 430 may synchronize video 112 with MIDI file 111. Merely by way for example, matching unit 430 may synchronize video 112 with MIDI file 111 of user karaoke performance. In some embodiments, matching unit 430 may give a feedback to MIDI operating module 320. In some embodiments, the feedback may include information regarding whether video 112 and MIDI file 111 are matched. In some embodiments, MIDI operating module 320 may further edit tick of MIDI file based on the feedback. In some embodiments, matching unit 430 may synchronize tick of MIDI file 111 with tick information converted by conversion model unit 420.

Control unit 440 may be configured to control musical instrument 110. In some embodiments, control unit 440 may control musical tone, state of keyboard, on/off state and/or press strength of keyboard or pedal of musical instrument 110. For example, control unit 440 may control on/off state of musical tone based on tick information of tick module 210. Additionally, control unit 440 may control press strength of keyboard and/or pedal based on current. In some embodiments, control unit 440 may control play mode of video 112. In some embodiments, the play mode may include fast-forward, slow-forward, fast-backward and slow-forward, or the like, or any combination thereof. In some embodiments, control unit 440 may control play speed of MIDI file 111 in order to synchronize with video 112. For example, control unit 440 may control MIDI file 111 to play slower/faster during playing video 112 in a mode of slow-forward/fast-forward.

In some embodiments, processing module 330 may include a universal processor, for example, a programed programmable logic device (PLD), a special integrated circuit (ASIC), a microprocessor, a system on chip (SoC), a digital signal processor (DSP), or the like, or any combination thereof. Two or more universal processors of processing module 330 may be integrated into a hardware device, or may be installed in two or more hardware devices. It should be understood, universal processor(s) in processing module 330 may be implemented according to various configurations. For example, in some embodiments, processing procedure of processing module 330 may be implemented by hardware, software, or a combination of hardware and software, not only by a hardware circuit in a programmable hardware device, an ultra large scale integrated circuit, a gate array chip, a semiconductor device (e.g., a transistor), a field programmable gate array, or a programmable logic device, and also by a software performed by various processors, or a combination of hardware and software illustrated above (e.g., firmware).

Figure 5:
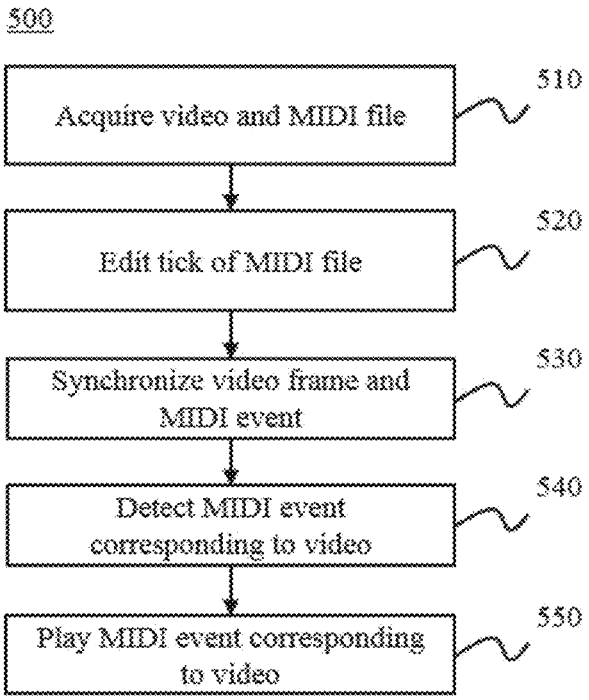
FIG. 5 is a flowchart illustrating an exemplary process for synchronizing MIDI file with video according to some embodiments of the present disclosure.

FIG. 5 illustrates a flowchart of an exemplary process for synchronizing MIDI file 111 with video 112 according to some embodiments of the present disclosure. In some embodiments, at 510, acquisition module 310 may acquire information. In some embodiments, information acquired at 510 may include data of a video, a MIDI file, an audio file, or the like, or any combination thereof. For example, the video data may include a performance of musical instrument 110 or other instruments. In some embodiments, acquisition module 310 may acquire video 112 and/or MIDI file 111 from database 140. In some embodiments, acquisition module 310 may record video 112 and MIDI file 111 that are associated with a same performance through musical instrument 110 simultaneously, alternately or at different time. In some embodiments, acquisition module 310 may acquire video 112 from database 140, and record MIDI file 111 through musical instrument 110. In some embodiments, acquisition module 310 may acquire MIDI file 111 from database 140, and record video 112 through musical instrument 110. In some embodiments, processer 120 may store the information acquired at 510 in musical instrument 110, processer 120, and/or database 140.

At 520, MIDI operating module 320 may edit MIDI file(s) acquired at 510. The MIDI file(s) edited at 520 may include MIDI file 111. In some embodiments, MIDI operating module 320 may edit one or more MIDI records of MIDI file 111. In some embodiments, MIDI operating module 320 may edit tick information, tone information, MIDI event information, and/or strength information of MIDI file 111. In some embodiments, MIDI operating module 320 may edit tick information of MIDI file 111 based on video 112.

At 530, matching unit 430 within processing module 330 may synchronize MIDI event with video frame based on tick information edited at 520. In some embodiments, identification unit 410 may identify time information of the video frame. In some embodiments, matching unit 430 may match MIDI event(s) with the video frame(s) based on the tick information of MIDI file 111 and time information of the video frame. For example, the processing module may exam the tick information of the MIDI file 111 and the tick information of the video frame, and match the tick information of the MIDI file 111 and video frame, so that when the video and the MIDI file are operated by the smart instrument system independently and simultaneously, the music corresponding to the MIDI file 111 and the video may be played synchronously. When the tick information of the MIDI file 111 and the tick information of the video do not match, simultaneously playing the MIDI file 111 and the video according to their corresponding tick information may result mismatch between the music and the video. Accordingly, the processing module 330 may edit the tick information of the MIDI file to make it match the tick information of the video. To this end, the processing module 330 may obtain the tick information of a video frame and determine a value thereof, then find the corresponding tick information of the MIDI file 111 (i.e., where the music and the video should have been played at the same time) and assign the tick value of the video frame to the corresponding tick value of the MIDI file. This may result the music corresponding to the MIDI file to be played faster or slower, so that when the video and the MIDI file are operated by the smart instrument system simultaneously, the music corresponding to the MIDI file 111 and the video may be played synchronously. When the smart instrument system is connected with a real instrument, such as piano, the MIDI file may be played on the instrument instead of on an electronic devices such as music player.

At 540, detection module 340 may detect MIDI event corresponding to video frame. In some embodiments, detection module 340 may detect MIDI event based on the synchronized MIDI event(s) at 530. In some embodiments, the video frame may refer to a video frame of video 112 currently playing in a display of musical instrument 110. In some embodiments, detection module 340 may execute a background thread. The background thread may detect MIDI event without interfering the play of video 112. In some embodiments, the background thread may detect MIDI event based on tick information converted from the timing information of video frame. For example, the background thread may detect MIDI event within a few milliseconds.

At 550, MIDI operating module 320 may play MIDI event detected at 540. In some embodiments, MIDI event may include on/off state of MIDI tone. For example, MIDI operating module 320 may play MIDI tone corresponding to the video frame in video 112 on a musical instrument. In some embodiments, video frame may include a musical instrument performance. For example, MIDI operating module 320 may play MIDI tone corresponding to keyboard pressing of video frame. In some embodiments, processing module 330 may transmit the MIDI event to musical instrument 110, and musical instrument 110 may perform the corresponding musical tone.

Figure 6:
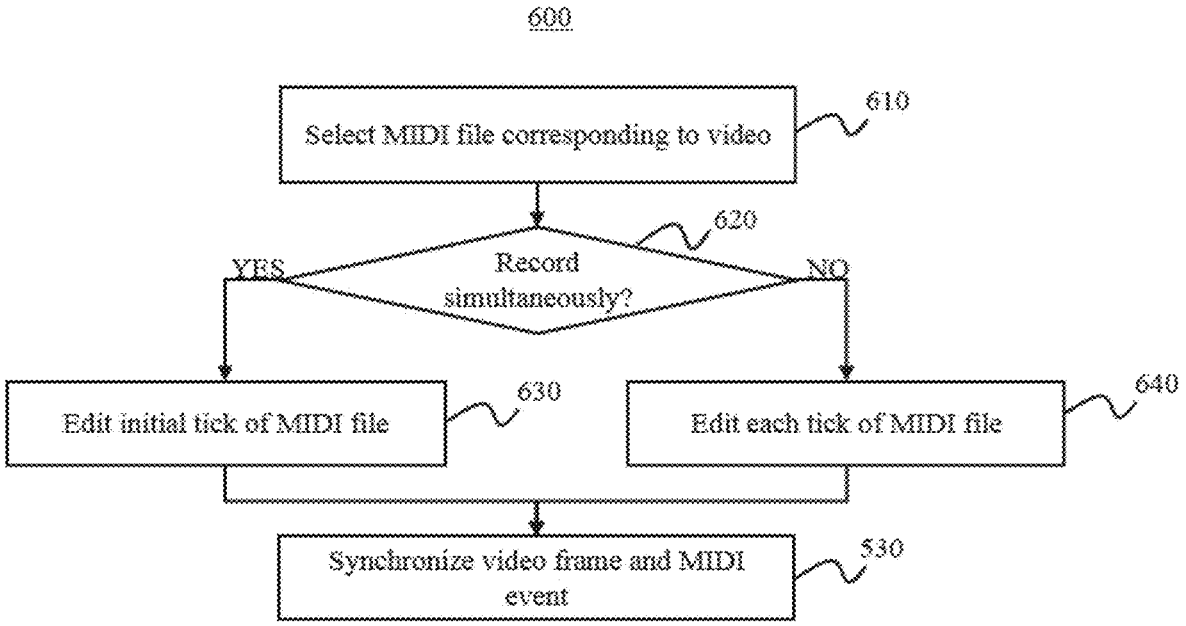
FIG. 6 is a flowchart illustrating an exemplary process for editing MIDI file according to some embodiments of the present disclosure.

FIG. 6 is a flowchart illustrating an exemplary process for editing MIDI file 111 according to some embodiments of the present disclosure. In some embodiments, at 610, detection module 340 may select MIDI file 111 corresponding to video 112 from the information acquired at 510. In some embodiments, the MIDI file may include a MIDI tone corresponding to the musical instrument performance in video 112. In some embodiments, the MIDI tone may be decorated with background music. In some embodiments, background music may include various musical instrument performance, e.g., for example, a piano music, an orchestral music, a string music, a wind music, and a drum music.

At 620, identification unit 410 within processing module 330 may determine whether MIDI file 111 and video 112 are recorded simultaneously or not. If identification unit 410 determines MIDI file 111 and video 112 are recorded simultaneously, processing module 330 may give instruction(s) to MIDI operating module 320 to edit the initial tick of MIDI file 111 at 630. If identification unit 410 determines MIDI file 111 and the video 112 are not recorded simultaneously, processing module 330 may give instruction(s) to MIDI operating module 320 to edit each tick of MIDI file. In some embodiments, tick(s) of MIDI file 111 may correspond to timing information of video 112. In some embodiments, MIDI operating module 320 may edit tick(s) of MIDI file 111 corresponding to timing information of video 112 in order to synchronize MIDI file 111 with video 112.

It should be noted that the above description of the process 600 is merely provide for the purpose of illustration, and not intended to limit the scope of the present disclosure. For persons having ordinary skills in the art, various variations and modification may be conducted in the light of the present disclosure. For example, step 620 may be skipped. In some embodiments, MIDI operating module 320 may edit tick(s) of MIDI file 111 directly based on timing information of video 112. However, the variations or modifications do not depart from the scope of the present disclosure.

Figure 7:
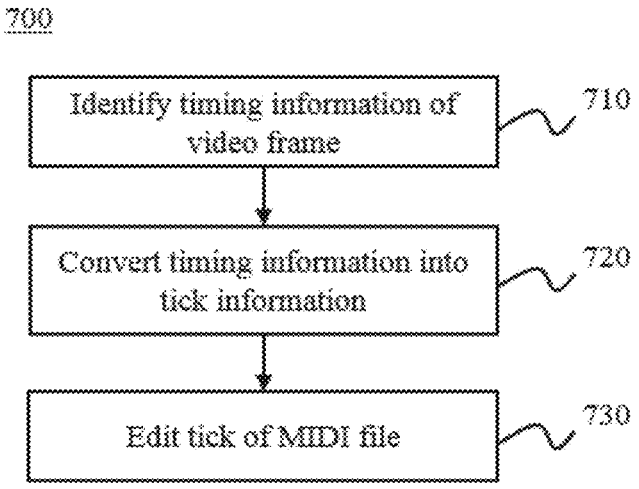
FIG. 7 is a flowchart illustrating an exemplary process for editing tick(s) of MIDI file according to some embodiments of the present disclosure.

FIG. 7 is a flowchart illustrating an exemplary process for editing tick(s) of MIDI file 111 according to some embodiments of the present disclosure. In some embodiments, at 710, detection module 340 may identify timing information of video frame(s) in video 112. In some embodiments, each video frame may correspond to timing information. The timing information may be used to match MIDI file 111 with video 112.

At 720, conversion model unit 420 may convert timing information identified at 710 into tick information. In some embodiments, conversion model unit 420 may convert timing information based on one or more mathematical models. In some embodiments, MIDI file 111 may include tick information used to match with timing information of video 112.

At 730, processing module 330 may give instruction(s) to MIDI operating module 320 to edit tick(s) of MIDI file 111 based on tick information converted at 720.

Figure 8:
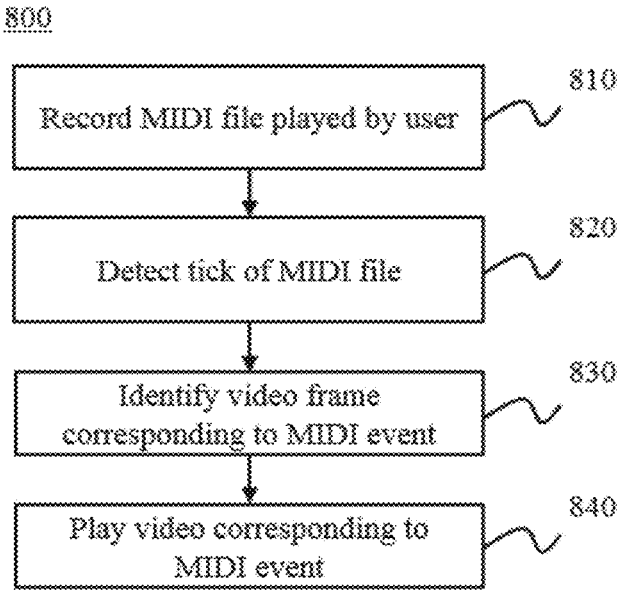
FIG. 8 is a flowchart illustrating an exemplary process for synchronizing video with MIDI file according to some embodiments of the present disclosure.

FIG. 8 is a flowchart illustrating an exemplary process for performing karaoke function according to some embodiments of the present disclosure. The karaoke function may be implemented by smart instrument system 100 according to process 800. At 810, acquisition module 310 may record a MIDI file played by user. In some embodiments, user may sing while playing musical instrument 110. For example, user may sing and/or play a piano in a low speed, a normal speed, a fast speed, or the like, or any combination thereof. In some embodiments, display module 350 may display lyrics corresponding to the playing and/or singing of the user.

At 820, detection module 340 may detect tick(s) of the MIDI file recorded at 810. In some embodiments, the MIDI file may include MIDI tone. In some embodiments, conversion model unit 420 within processing module 330 may convert tick information of the MIDI file into timing information. For example, conversion model unit 420 may convert tick information of the MIDI file based on one or more mathematical model(s).

At 830, identification unit 410 within processing module 330 may identify video frame(s) corresponding to MIDI event of the MIDI file recorded at 810. In some embodiments, identification unit 410 may identify video frame(s) based on the timing information converted from tick information at 820. For example, video frame(s) may be synchronized with MIDI event(s) based on the timing information. In some embodiments, the video frame(s) may include lyrics. Lyrics may be displayed in a speed matching the MIDI event(s).

At 840, display module 350 may display a video corresponding to MIDI event. In some embodiments, the video may be detected by a background thread performed by processing module 330. In some embodiments, the video may detected based on the timing information converted from tick information at 820. For example, the video matching the MIDI event(s) may be displayed. Specifically, lyrics may be displayed synchronizing with user singing and playing during karaoke function.

Figure 9:
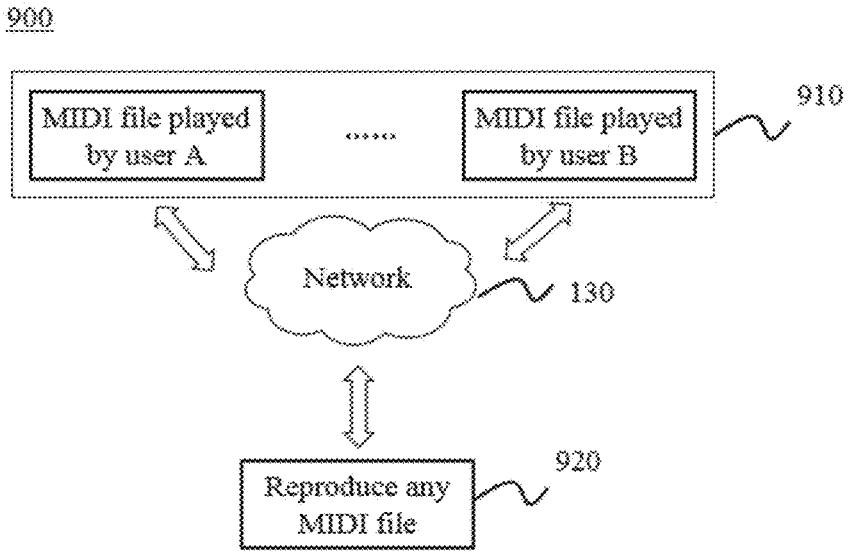
FIG. 9 illustrates a block diagram of an exemplary remote sync configuration of smart instrument system according to some embodiments of the present disclosure.

FIG. 9 illustrates a block diagram of an exemplary remote sync configuration of smart instrument system 100 according to some embodiments of the present disclosure. Exemplary configuration 900 may be a block diagram illustrating a situation of remote performance of musical instrument 110. In some embodiments, MIDI file(s) 910 may be played by different users (i.e., user A, . . . , user B). For example, user may include a musician, a pianist, a music star, a celebrity, a musical educator, a piano professor, or the like, or any combination thereof.

In some embodiments, various MIDI files 910 played by different users may be shared via network 130. In some embodiments, a MIDI file within MIDI files 910 may be reproduced at 920. For example, a user may select and reproduce a MIDI file played by his/her favorite music star. In some embodiments, MIDI file may be reproduced at real time via remote live performance. For example, a singer may play the piano with a pianist via the network 130 during his/her concert. The pianist may play a piano remotely. A first smart piano system local to the pianist may record the MIDI file of the pianist's performance and send the MIDI file to a second smart piano system local to the singer. The second smart piano system may receive the MIDI file and play on a piano local to the singer, so that the singer may perform as if the pianist were sitting together with him or her.

Figure 10:
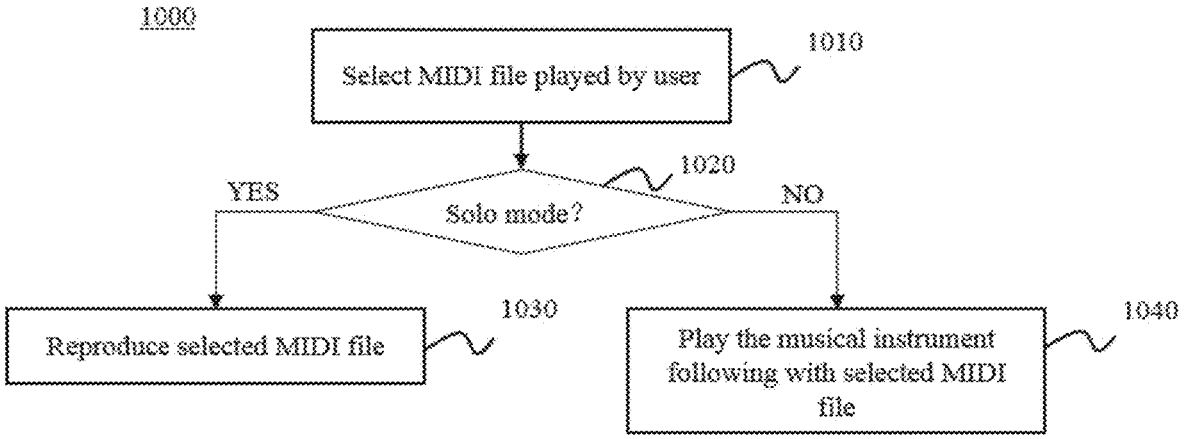
FIG. 10 is a flowchart illustrating an exemplary process for reproducing instrumental performance according to some embodiments of the present disclosure.

FIG. 10 is a flowchart illustrating an exemplary process for reproduction of instrumental performance, remote in distance or time, according to some embodiments of the present disclosure. At 1010, a MIDI file played by a user may be selected. In some embodiments, MIDI file may be edited directly. In some embodiments, MIDI file(s) may be played by various users, such as a musician, a pianist, a music star, a celebrity, a musical educator, a piano professor, or the like, or any combination thereof. For example, a piano hobbyist may select a MIDI file played by a pianist.

At 1020, identification unit 410 within processing module 330 may determine whether to play musical instrument 110 in a solo mode or not. If identification unit 410 determines to play in a solo mode, MIDI operating module 320 may reproduce selected MIDI file at 1030. For example, the piano may be played in an automotive mode to reproduce selected MIDI file without user participation. If identification unit 410 determines to play in a non-solo mode, MIDI operating module 320 may reproduce selected MIDI file along with user playing at 1040. For example, the piano may be played in a semi-automotive mode to reproduce selected MIDI file with user playing.

In some embodiments, smart instrument system 100 may be used in a remote live performance. For example, a MIDI file may be recorded and transmitted (real-time or not) via network 130. A user may play musical instrument 110 following with recorded MIDI file. In some embodiments, smart instrument system 100 may reproduce performance of musical instrument 110. For example, a MIDI file may be played by a pianist. A concert may be reproduced by the performance of the pianist based on the MIDI file. In some embodiments, user may play musical instrument 110 with a music star online. In some embodiments, user may play musical instrument 110 with a music star offline based on the MIDI file.

Therefore, musicians at different locations may perform together or perform at different time to make a piece of music. To this end, a first musician may play a first component of the music corresponding to a first instrument on a corresponding smart instrument system. The MIDI file of the first musical component may be recorded by the smart instrument system and sent to a second smart instrument system located in a target location. Similarly, MIDI files of a second, a third, and/or more components of the music may be recorded and sent to a corresponding smart instrument systems in the target location. When the MIDI files of each musical component of the piece of music are collected, the MIDI files may be synchronized according to a reference (e.g., a performance video) and then played at the target location by the corresponding local smart instrument systems. By this way, a symphony or music may be reproduced by real instruments that play in the same way as a remote musician does or did.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure, and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module" or "system." Furthermore, aspects of the present disclosure may take the form of a computer program product embodied in one or more computer readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB. NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

What is claimed is:

1. A system comprising:

a smart instrument configured to obtain a video and a musical instrument digital interface (MIDI) file associated with a music, the video including a plurality of video frames, and the MIDI file including a plurality of ticks;

a non-transitory storage medium including a set of instructions for synchronizing the video with the MIDI file; and one or more processors in communication with the non-transitory storage medium, wherein when executing the set of instructions, the one or more processors are configured to cause the system to:

identify timing information of at least one video frame of the plurality of video frames;

convert the timing information into tick information; and edit at least one tick of the MIDI file based on the tick information, so that when playing, the music is synchronous with the video.

2. The system of claim 1, wherein the one or more processors are further configured to cause the system to:

play the video; and simultaneously play the MIDI file on a musical instrument associated with the smart instrument system.

3. The system of claim 2, wherein the video is played in a mode comprising slow-forward, fast-forward, skip, backward, pause, or stop.

4. The system of claim 2, wherein the video comprises a musical instrument performance.

5. The system of claim 2, wherein the musical instrument comprises a piano.

6. The system of claim 1, wherein to edit the at least one tick of the MIDI file, the one or more processors are further configured to cause the system to:

determine a value of the tick information corresponding to a vide frame of the plurality of video frames;

determine a tick of the MIDI file corresponding to the video frame; and assign the value to the tick.

7. The system of claim 1, wherein the MIDI file comprises information of a tick, a tone, a MIDI event and a strength.

8. The system of claim 1, wherein the video and the MIDI file are recorded separately.

9. The system of claim 1, wherein the MIDI file is a first MIDI file associated with the music; and the one or more processors are further configured to cause the system to:

obtain a second MIDI file associated with the music, the second MIDI file including a plurality of ticks; and edit at least one tick of the second MIDI file based on the video tick information, so that when playing, the music is synchronous with the video.

10. The system of claim 1, wherein the one or more processors are further configured to cause the system to simultaneously play the second MIDI file on a musical instrument associated with the smart instrument system.

11. A method implemented on at least one device each of which has at least one processor and a storage, the method comprising:

obtaining, by a smart instrument system, a video and a musical instrument digital interface (MIDI) file associated with a music, the video including a plurality of video frames, and the MIDI file including a plurality of ticks;

identifying, by the smart instrument system, timing information of at least one video frame of the plurality of video frames;

converting, by the smart instrument system, the timing information into video tick information; and editing, by the smart instrument system, at least one tick of the MIDI file based on the video tick information, so that when playing, the music is synchronous with the video.

12. The method of claim 11, further comprising playing the video by the smart instrument system; and simultaneously playing, by the smart instrument system, the MIDI file on a musical instrument associated with the smart instrument system.

13. The method of claim 12, wherein the video is played in a mode comprising slow-forward, fast-forward, skip, backward, pause, or stop.

14. The method of claim 12, wherein the video comprises a musical instrument performance.

15. The method of claim 12, wherein the musical instrument comprises a piano.

16. The method of claim 11, wherein the editing of the at least one tick of the MIDI file comprising:

determining a value of the tick information corresponding to a vide frame of the plurality of video frames;

determining a tick of the MIDI file corresponding to the video frame; and assigning the value to the tick.

17. The method of claim 11, wherein the MIDI file comprises information of a tick, a tone, a MIDI event, and a strength.

18. The method of claim 11, wherein the video and the MIDI file are recorded separately.

19. The method of claim 11, wherein the MIDI file is a first MIDI file associated with the music; and the method further comprises:

obtaining, by the smart instrument system, a second MIDI file associated with the music, the second MIDI file including a plurality of ticks; and editing, by the smart instrument system, at least one tick of the second MIDI file based on the video tick information, so that when playing, the music is synchronous with the video.

20. The method of claim 11, further comprising simultaneously playing, by the smart instrument system, the second MIDI file on a musical instrument associated with the smart instrument system.

* * * * *